US006361736B1

(12) United States Patent
Dugan et al.

(10) Patent No.: US 6,361,736 B1
(45) Date of Patent: Mar. 26, 2002

(54) SYNTHETIC FIBER FORMING APPARATUS FOR SPINNING SYNTHETIC FIBERS

(75) Inventors: Jeffrey S. Dugan, Erwin; Frank O. Harris, Rogersville, both of TN (US)

(73) Assignee: Fiber Innovation Technology, Johnson City, TN (US)

( * ) Notice: Subject to any disclaimer, the term of this patent is extended or adjusted under 35 U.S.C. 154(b) by 0 days.

(21) Appl. No.: 09/137,435

(22) Filed: Aug. 20, 1998

(51) Int. Cl.[7] ..... D01D 4/06

(52) U.S. Cl. ..... 264/772.15; 264/176.1; 425/463; 425/464; 425/131.5

(58) Field of Search ..... 425/463, 464, 425/131.5; 264/172.15, 176.1

(56) References Cited

U.S. PATENT DOCUMENTS

| | | | | |
|---|---|---|---|---|
| 3,192,562 A | | 7/1965 | Powell | 425/131.5 |
| 3,466,703 A | | 9/1969 | Heckrotte | 425/131.5 |
| 3,787,162 A | | 1/1974 | Cheetham | 425/131.5 |
| 3,807,917 A | | 4/1974 | Shimoda et al. | 425/131.5 |
| 3,849,044 A | | 11/1974 | Ando et al. | 425/131.5 |
| 4,052,146 A | | 10/1977 | Sternberg | 425/131.5 |
| 4,406,850 A | | 9/1983 | Hills | 425/131.5 |
| 4,717,487 A | | 1/1988 | Griffith et al. | 425/131.5 |
| 4,773,528 A | | 9/1988 | Anderson et al. | 425/131.5 |
| 4,875,844 A | | 10/1989 | Nakajima et al. | 425/131.5 |
| 5,035,595 A | | 7/1991 | Nakajima et al. | 425/131.5 |
| 5,227,109 A | | 7/1993 | Allen, III et al. | 425/131.5 |
| 5,234,650 A | | 8/1993 | Hagen et al. | 425/131.5 |
| 5,344,297 A | | 9/1994 | Hills | 425/131.5 |
| 5,380,477 A | | 1/1995 | Kent et al. | 264/172.15 |
| 5,393,219 A | | 2/1995 | Hagen et al. | 425/131.5 |
| 5,405,698 A | | 4/1995 | Dugan | 428/373 |
| 5,411,693 A | | 5/1995 | Wust, Jr. | 264/172.15 |
| 5,445,884 A | | 8/1995 | Hoyt et al. | 428/370 |
| 5,466,410 A | | 11/1995 | Hills | 264/176.1 |
| RE35,108 E | | 12/1995 | Hagen et al. | 425/131.5 |
| 5,511,960 A | * | 4/1996 | Terakawa et al. | 425/7 |
| 5,533,883 A | | 7/1996 | Hodan et al. | 425/131.5 |
| 5,551,588 A | | 9/1996 | Hills | 216/56 |
| 5,562,930 A | | 10/1996 | Hills | 425/131.15 |
| 5,575,063 A | | 11/1996 | Hodan et al. | 29/557 |
| 5,620,644 A | | 4/1997 | Hodan et al. | 264/172.15 |

FOREIGN PATENT DOCUMENTS

| | | |
|---|---|---|
| FR | 2429274 | 6/1979 |
| GB | 2 024 096 A | 6/1979 |

* cited by examiner

*Primary Examiner*—Nam Nguyen
*Assistant Examiner*—Thu Khanh T. Nguyen
(74) *Attorney, Agent, or Firm*—Alston & Bird LLP

(57) ABSTRACT

A synthetic fiber forming apparatus is disclosed for the manufacture of a variety of synthetic fibers at an improved rate of efficiency and uniformity. The synthetic fiber forming apparatus includes a distribution plate and a metering plate which is positioned downstream of the distribution plate. The distribution plate contains at least one flow path which is in fluid flow connection with at least one exit hole in the distribution plate. The metering plate contains at least one orifice which is desirably positioned immediately downstream of the distribution plate exit hole, and which is adapted to meter the flow of a flowable material therethrough. The metering plate orifice is desirably smaller than the distribution plate exit hole and preferably a plurality of orifices are in fluid flow connection with a single distribution plate exit hole. The metering plate acts to provide a flowable material at a consistent pressure to the spinneret. A process for manufacturing synthetic fibers at a high rate of consistency and uniformity is also described.

38 Claims, 5 Drawing Sheets

SYNTHETIC FIBER FORMING APPARATUS FOR SPINNING SYNTHETIC FIBERS

FIELD OF INVENTION

The present invention relates to an apparatus and method for the production of synthetic fibers. In particular, the invention relates to an apparatus and method for the production of spun synthetic fibers having improved uniformity and production efficiencies.

BACKGROUND OF THE INVENTION

The expanding use of synthetic fibers has had a significant impact on the textile industry. Synthetic fibers are now used in many textile applications where natural fibers were traditionally used. This movement to the use of synthetic fibers mainly has been facilitated by their typically superior physical properties and relatively low manufacturing costs. In addition, synthetic fibers can be tailor-made to have a variety of different properties in order to enhance their applicability in numerous types of applications such as clothing, roping, industrial materials, and many other applications. For example, the material used, the fiber cross-sectional shape, the fiber size, etc. can be pre-selected to form a fiber which has the requisite features preferred for its intended end use. Further, where varieties of features or properties are required, multi-component synthetic fibers can be produced and utilized, with the individual fiber components being selected to provide specific features. In the production of such multi-component fibers, the manufacturer can control the cross-sectional shape of each of the various components as well as their relative proportions in the fiber structure. In this way, multi-component fibers enable a user to capitalize on the particular features of multiple different synthetic materials simultaneously, often with synergistic results.

The most common methods for producing synthetic filaments are spinning processes. Relatedly, such spinning processes also form intermediate stages in the production of nonwoven fabrics such as during spunbonding and melt-blowing nonwoven fabric production processes. In these spinning processes, a flowable material (e.g., a solution-dissolved or molten polymer) is fed in a selected manner to a spinneret. The liquified material passes through the spinneret where it emerges in a plurality of thin material streams which are quenched (e.g., by a gaseous or liquid medium) in order to solidify the flowable material streams, thereby forming spun filaments.

Typically, when a plurality of synthetic fibers are produced, it is desirable for the individual fibers of the plurality to have relatively uniform cross-sectional dimensions, in order that uniform properties are consistently provided by each fiber. In commercial manufacturing environments, however, irregularities in fiber structures are commonly and undesirably introduced during fiber production, and variations can occur between the individual fibers relative to each other as well as along the length of each individual fiber.

One example of synthetic fiber production is described in U.S. Pat. Nos. 5,162,074 and 5,344,297 to Hills. In the manufacturing processes described in those patents, flowable polymer material is passed under pressure to etched distribution plates containing horizontal flow paths. The polymer material flows from an inlet point through these flow paths on the etched plate, where it is directed into the backholes of a spinneret. These horizontal flow paths can present several problems in the manufacturing process.

First, because the etched plate is designed to receive the flowable polymer material and to distribute it to the spaced backholes of the spinneret, the individual flow paths of the etched plate would thus, absent any intentional modification to their design, generally have different lengths and/or dimensions. This difference in the path lengths can cause the flowable polymer material in the longer flow paths to experience a larger drop in pressure than the polymer material in the shorter flow paths. This pressure differential between the materials in the different flow paths can thus cause the feed rate of the flowable polymer material to the spinneret backholes to vary, which can adversely affect the shape of the polymer streams exiting the spinneret. These pressure differentials can represent an even greater problem in the production of multi-component fibers, since the feeding of the flowable materials to form particular multi-component fibers typically needs to be very precise.

Because in the prior art methods the pressure irregularities are introduced downstream of the pressure regulating means (i.e., generally a metering plate proximate the material supply point), the pressure irregularities tend to manifest themselves directly in the form of irregularities in the spun fibers. To combat this problem, prior art methods have employed distribution plates where the shorter path lengths are intentionally lengthened so as to equalize the lengths for all of the flow paths. In other words, some channels are made longer than necessary, to achieve a particular fiber construction. This lengthening of the channel increases the dwell time of the flowable material, which can lead to undesirable and otherwise unnecessary polymer degradation. In addition, the extended length channels consume plate area which might be otherwise beneficially used. As a result of this loss of space, cross-sectional design complexity of the fibers can be limited, since more complex designs typically require more channels (and thus more plate space). In addition, the hole density in the spinneret must be correspondingly reduced, since the holes must be located farther apart when the channels take up a greater proportion of plate space. As a result, the through-put rate (and thus productivity) can be undesirably reduced.

Another problem can be experienced when the flow paths of a distribution plate are connected to exit holes with large cross-sectional dimensions. As the polymer material flows from the flow path into the distribution plate exit hole, more of the polymer material is distributed to the area of the exit hole nearest to the flow path outlet than to the opposite sides of the exit hole. This causes an uneven distribution of flowable polymer material to be fed to the spinneret, and as a result, generally precludes the use of the shape and size of the exit hole of the distribution plate in helping to determine the cross-sectional distribution of the respective polymers in the resulting fiber. Consequently, distribution plate designers generally must avoid the use of large and shaped exit holes. Instead, the cited art allows only the positioning of exit holes relative to each other to determine the multi-component cross-section, which is a less certain method than the one of the instant invention, which allows the use of the size and shape of the exit holes to determine the fiber configuration as well.

Accordingly, there exists a need for a method and apparatus for producing synthetic fibers having improved uniformity and for providing improved control over fiber cross-sectional shape.

SUMMARY OF THE INVENTION

In light of the above, it would be advantageous to provide a method and apparatus for improving the uniformity of synthetic fibers, while increasing the ease of achieving complexity of the design of a multi-component fiber cross-section. The present invention provides such consistent uniform fiber spinning by generally restoring and/or initiating a pressure equilibrium to the flowable material streams as they are delivered to the spinneret. This in turn allows the spinneret to produce synthetic fibers with more uniform structures and properties. Because the apparatus in one embodiment of the present invention can be used to actually create the requisite pressure for the spinning process, in that embodiment the pressure equipment located upstream of the distribution plate, such as the pressure and metering plates often utilized to provide pressure in conventional spin pack arrangements, can essentially be eliminated.

These and other advantages are provided according to the present invention by an apparatus for forming synthetic fibers which includes a distribution plate for distributing flowable material in a direction perpendicular to the spinning direction, and one or more metering plates positioned downstream of the distribution plate and likewise oriented perpendicular to the spinning direction. (For purposes of this disclosure, elements described as being "perpendicular" are oriented perpendicular relative to the spinning direction, while those described as "parallel" are oriented parallel to the spinning direction, e.g., in a vertical spinning operation, elements oriented perpendicularly would be in a horizontal position relative to the vertical spinning direction.)

The distribution plate contains at least one flow path which is in fluid flow connection with at least one generally parallel exit hole which forms a portion of a downstream surface of the distribution plate. It is to be noted that the term "exit hole", as used in connection with the instant invention, is meant in its broadest sense to encompass the downstream orifice(s) of a plate or cooperating combination of plates, and is intended to encompass all such downstream cavities regardless of whether larger or smaller than the upstream supply channel opening, and regardless of their shape relative to that of the supply channel. Furthermore, while the term "distribution plate" appears in singular form, it is intended to encompass all distribution plate arrangements which perform a flowable material distribution function in the manner described in the instant application. For example, the distribution plate can comprise several plate elements which cooperatively function to direct at least one flowable material to a location other than that in which it would be located when exiting the material supply arrangement located immediately upstream of the distribution plate by either directing it perpendicularly relative to its feed position and/or expanding or shaping the flowable material stream from its input dimensions and configuration. Additionally, it is to be noted that the term "parallel" is intended to describe the axis of the exit hole as compared with the general overall flow direction (i.e., upstream towards downstream) of the spinning assembly.

The metering plate contains at least one, and preferably at least two orifices which are desirably positioned immediately downstream of an exit hole of the distribution plate. At least a portion of the metering plate orifice (i.e., preferably the downstream portion of the orifice) has a combination of diameter and length sufficient to moderate the pressure of flowable material flowing through the metering plate. In this way, the metering plate achieves a greater degree of equilibration of the pressures of the flowable material(s).

In some instances, the size of the metering plate orifice(s) and the thickness of the metering plate can be specially dimensioned to produce a defined pressure increase in the flowable material. In fact, the metering plate orifice(s) and/or the thickness of the metering plate can be sized to produce a pressure on the flowable material as it exits the metering plate which is alone sufficient for balanced-pressure feed to the spinneret, thereby essentially obviating the need for upstream pressurization means. Furthermore, selected portions of the metering plate can have different orifice configurations, in order to moderate material streams exiting their respective corresponding distribution plate exit holes at different levels.

In the action of the spinneret, it is typically advantageous to have the flowable material oriented in a parallel condition relative to the spinning direction before it enters the spinneret. Thus the metering plate orifice, in a preferred embodiment, orients the flowable material to produce a parallelly-oriented flowable material which is distributed to the spinneret.

In one embodiment of the invention, a second metering plate is also positioned upstream of the distribution plate. In this embodiment, the upstream metering plate provides flowable material to the distribution plate at an initial consistent pressure, with material pressure being re-equilibrated upon exit from the distribution plate by the downstream metering plate.

Typically, a spinneret has a plurality of backholes and mating exit orifices in order that a number of fibers can be spun simultaneously. Therefore, the downstream metering plates used in the present invention desirably have at least one, and preferably two orifices which mate with each of the spinneret backholes which are intended to be active during the spinning process. For some applications, it is advantageous to provide a plurality of flowable material streams to a single spinneret backhole. In light of this, in certain embodiments of the invention, the downstream metering plate has a plurality of orifices which direct flowable material into each of the active individual spinneret backholes. Preferably, at least a portion of each orifice of the plurality is smaller than the distribution plate exit hole to which it corresponds. The plural orifices of the metering plate receive the flowable material from the distribution plate exit hole(s) and output plural flowable material streams. The metering function of the orifices causes the material to flow at equilibrated pressure through each metering orifice fed by the larger, corresponding distribution plate exit hole, rather than flowing preferentially through the metering orifice nearest the channel feeding the distribution plate exit hole. In this way, the plural material streams can be fed to a single spinneret backhole as desired, thereby enabling the pattern of stream feeding to approximate the shape of areas of particular materials in the particular fiber configuration sought to be produced. Such a feeding arrangement has particular advantages in the production of multi-component fibers, as it provides a high degree of precision in the feeding of the stream to the backhole of the spinneret while at the same time, maintaining consistent pressure between the plural streams.

In many applications using this multi-stream embodiment, it is advantageous to have equilibrium between each individual stream of the plurality of flowable material streams. Therefore, in this embodiment, the size of the individual orifices of the plurality of metering plate orifices and the thickness of the metering plate are desirably sufficiently uniform such that the pressure of any one of the plurality of streams is approximately equilibrated to the pressure of any other stream of the plurality of flowable material streams as they exit the metering plate and flow toward the spinneret.

Some synthetic fiber forming applications require the flowable material to be distributed to different areas of the spinneret. In this embodiment, the distribution plate may contain at least two flow paths which each distribute the flowable material(s) to at least one distribution plate exit hole located at a desired position on the distribution plate. Due to this configuration, the flow paths may be of differing lengths and thus provide different pressure losses to the flowable polymer streams. This problem, left unmodified, would result in flowable polymer streams with differing pressures. To counteract this, in one embodiment of the invention, the shape, configuration and dimensions of orifices in the metering plate and the thickness of the metering plate are such that the pressure increase through any exit hole of the plurality of exit holes in the metering plate is large enough to thereby produce a plurality of flowable material streams where the pressure of one stream of the plurality of flowable material streams is approximately equilibrated to the pressure of any other stream of the plurality. In a particularly preferred form of this embodiment, each flow path in the distribution plate includes at least one exit hole such that the individual streams are combined downstream of the distribution plate. For example, the material streams may be combined in shaped cavities immediately upstream of the metering plate, although in most cases they will be combined in the spinneret backhole just downstream of the metering plate. This embodiment of the invention has particular applicability to the production of multi-component fibers, as it enables precise positioning of each of the fiber components.

In some synthetic fiber constructions, it is advantageous to produce synthetic fibers where the fiber contains many shaped aspects, such as a shaped core and shaped outer sheath. In this instance, the distribution plate exit hole(s) can be formed in predetermined shape(s) for producing and distributing a flowable material stream with a predetermined shape. In this embodiment, the metering plate is desirably configured such that a plurality of metering plate orifices correspond to at least one of the distribution plate exit holes. The plurality of orifices of the metering plate which receive each of the shaped flowable material streams then output to the spinneret a plurality of flowable material streams which collectively substantially maintain the predetermined shape. In a particularly preferred embodiment, the plurality of orifices in the metering plate outputs to a spinneret backhole a plurality of flowable material streams, wherein the pressure of one flowable material stream is approximately equilibrated to the pressure of any of the other flowable material streams.

In addition, the invention involves a process for increasing the consistency of synthetic fibers produced in a spinneret. The process involves directing a flow of material across a distribution plate and thereafter through a hole to an adjacent metering plate which moderates and more consistently controls the pressure of the flowable material. Generally this is performed by providing a metering plate which has a downstream orifice that is smaller than the exit hole of the distribution plate, although other forms of metering plate could be used, such as a metering plate having metering orifices which are larger than the distribution plate exit hole, but with the metering holes being long enough for drag from the hole walls to produce the desired pressure drop. After this moderation, the equilibrated pressure flowable material streams are directed from the exit holes of the metering plate orifices to the backhole(s) of a downstream spinneret.

Thus, in the apparatus and process of the present invention, the metering plate downstream of the distribution plate can serve to improve the balance of pressures between a plurality of flowable material streams (whether they are being fed to a single or to plural spinneret backholes) and to create pressure in the flowable material streams, in some cases to an extent sufficient to obviate the need for upstream pressure means.

In another embodiment of the invention,the distribution plate exit hole dispenses a flowable material having a predetermined cross-sectional shape to a plurality of orifices in the metering plate. The higher resistance met by the polymer trying to flow through the metering orifices causes it to fill the upstream shaped cavity before it is able to flow steadily through the metering orifices. Thus, in this embodiment, the plurality of orifices in the metering plate desirably adjust the pressure of the shaped flowable material and produce a plurality of flowable material streams which collectively maintain the predetermined shape such that the flowable material is fed to the downstream spinneret backholes at relatively balanced pressures in a shape which approximates that desired for a particular portion of the cross-section of the spun fiber. As a result, more precisely defined and uniform fiber cross-sections can be produced along the entire fiber length.

Further, the apparatus of the present invention also promotes efficiency in the forming of synthetic fibers. The orifices of the metering plate can be designed with appropriate dimensions such as to create the requisite pressure for the spinning process. This in turn would alleviate the need for the conventional metering plates which are placed upstream of the distribution plate, which is particularly desirable due to the high costs typically associated with these plates. Because the feeding of the flowable material can be more consistent in the apparatus and process of the present invention, better uniformity in fiber-to-fiber cross-sections and better control over the cross-section of each individual fiber can be achieved.

DETAILED DESCRIPTION OF THE PREFERRED EMBODIMENTS

Figure 1:
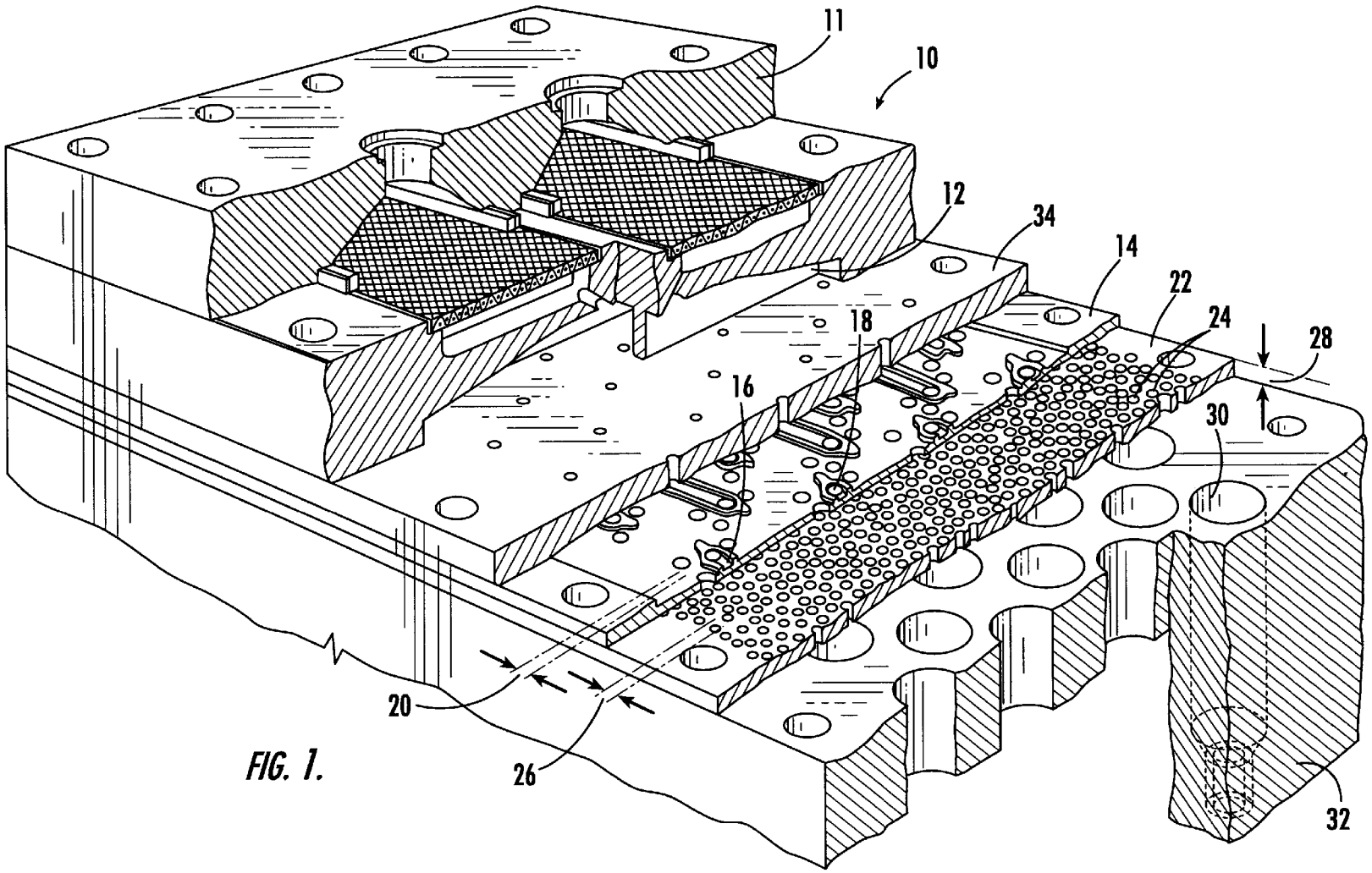
FIG. 1 is a perspective view of a synthetic fiber forming apparatus in accordance with the present invention.

The present invention will now be described more fully hereinafter with reference to the accompanying drawings, in which a preferred embodiment of the invention is shown. This invention may, however, be embodied in many different forms and should not be construed as limited to the embodiments set forth herein; rather, this embodiment is provided so that this disclosure will be thorough and complete and will fully convey the scope of the invention to those skilled in the art. Like reference characters designate like or corresponding parts throughout the several views. For the sake of clarity of the illustration, the flowable material is not specifically included in the drawings, but will be understood to flow through the illustrated embodiments of the invention as further described herein.

The synthetic fiber forming apparatus of the present invention may be used to produce a variety of synthetic fibers (e.g., polyester, nylon, rayon, etc.) including both single and multi-component material configurations.

FIG. 1 is a perspective view of a synthetic fiber forming apparatus 10 for forming a variety of synthetic fibers according to the instant invention. The upper material supply portion of the apparatus 10 according to the present invention can be formed in a conventional manner. For example, the supply portion of the apparatus 10 can include a conventional-type top plate 11 which receives one or more materials through inlet bores and transfers the material to a screen support plate 12, which filters the flowable material and forwards it towards a distribution plate.

As illustrated, the apparatus 10 desirably includes a distribution plate 14 which has at least one flow path 16 oriented in a direction perpendicular to the spinning direction and at least one exit hole 18. The apparatus 10 also includes a metering plate 22 which has at least one orifice 24 which desirably extends in a direction substantially parallel to the spinning direction, and a common flow path with at least one exit hold of the distribution plate 14. For example, in the apparatus 10, the metering plate 22 is positioned downstream of the distribution plate 14 such that plural orifices 24 of the metering plate 22 are immediately downstream of each of the distribution plate exit holes 18. The orifices 24 in the metering plate 22 are adapted to moderate the pressure of a material flowing from an exit hole of the distribution plate through the metering plate. For example, the diameter of at least a portion of the metering plate orifice 24 (shown at 26) is desirably smaller than the diameter of the distribution plate exit hole 18 (shown at 20) such that it moderates the pressure of a material flowing from the distribution plate 14 through the metering plate 22, to thereby provide a flow of material to a downstream spinneret 32 at a relatively more consistent pressure. For example, the exit holes 18 of the distribution plate 14 can be about 0.6 mm in diameter, while the exit holes of a mating metering plate 22 could be about 0.2 mm in diameter. While throughout the specification and claims it is described that the metering plate feeds flowable material to the backholes of a spinneret, it is noted that this is to include set-ups where the metering plate directly feeds the spinneret, and those where it feeds a transition plate which in turn feeds the spinneret backholes, as will be discussed further herein.

The distribution and metering plates 14, 22 can be made using any known shaping means including, but not limited to, etching, electroforming, laser-cutting, milling, LIGA-technique, casting, stamping, punching, drilling or otherwise machining, molding, engraving, reaming, or the like. In a preferred form of the invention, the distribution plate holes 18 are "shaped" (i.e., non-circular) in order to produce multi-component fibers having selectively shaped regions of specific components. Similarly, the flow paths 16 can assume any configuration chosen by the plate designer to achieve the desired fiber shape, composition and cross-section, and can be of greater complexity than practicable using prior art spin pack assemblies, as will be readily recognized by those having ordinary skill in the art.

In a preferred form of the invention, the diameter of each of the metering plate orifices 24 is consistent along the length of the orifice (i.e., through the entire thickness of the metering plate.) Alternatively, a downstream or outlet end of the exit orifice 24 could be formed to have a smaller diameter than that of the downstream end of the exit hole of the distribution plate 14, to thereby provide a pressure increase to flowable material flowing therethrough. As a further alternative, the diameter of the orifices 24 of the metering plate can have a narrowed diameter between its upstream and downstream ends to form a neck.

In certain embodiments of the present invention, the thickness 28 of the metering plate 22 and/or the diameter of the metering plate orifices 24 are sized sufficiently to moderate the pressure on the flowable material stream through the metering plate orifice 24, thereby providing a flowable material stream with a determinable pressure to the spinneret 32. In a further aspect of the present invention, the metering plate orifice 24 orients a flowable material stream to produce an oriented flowable material stream for output to the spinneret 32.

Figure 4:
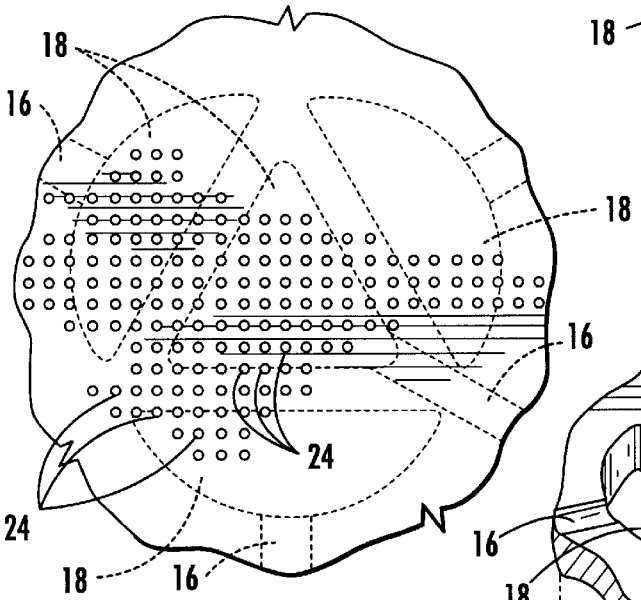
FIG. 4 is a top view of a metering plate which can be used in the present invention, with the material flow paths and shaped exit holes of the distribution plate shown in FIG. 3 appearing in dashed lines as they would overlie the metering plate.

The metering plate 22 of the apparatus 10, shown in more detail in FIG. 4, desirably has a plurality of orifices 24. The metering plate 22 may be constructed so that it has a single orifice 24 corresponding to each exit hole 18 of the distribution plate 14, or such that plural orifices 24 of the metering plate correspond to one or more of the exit holes 18, as shown, for example, in FIGS. 4–5. Each orifice 24 of the plurality of orifices 24 is desirably smaller than the corresponding distribution plate exit hole 18, although other orifice designs can be used within the scope of the invention, as discussed above. A spinneret 32 is desirably positioned downstream of the metering plate 22 such that the plurality of orifices 24 deliver a plurality of flowable material streams to one or more backholes 30 thereof. The metering plate can be in the form of a conventional punched, stamped, milled, laser-cut, drilled, reamed, etched or otherwise machined plate, can be made by casting, molding, or LIGA process, engraving or electroforming or can be in the form of a screen formed of fibers, filaments, wires, or the like. For example, a mesh screen having about 125 holes per inch could be used to meter the flowable material through the apparatus of the instant invention. Alternatively, the metering plate can be made by selectively plugging holes in an existing plate or screen. As will be recognized by those having ordinary skill in the art, the dimensions of the orifices, number of orifices adapted to correspond to each of the distribution plate exit holes, shape of the orifices, etc. will be selected to provide the desired degree of metering for the particular desired fiber construction to be produced. For example, for the arrangement illustrated in FIG. 4, it may be desirable to have as many as 500 orifices in the metering plate corresponding to the single shaped triangular shaped exit hole in the center of that distribution plate.

In a further aspect of the invention, the size of each orifice 24 of the metering plate 22 and the thickness 28 of the metering plate 22 across its width are designed so that the pressure of any single stream of flowable material of the plurality of flowable material streams is substantially equilibrated to the pressure of any other stream of the plurality.

Figure 3:
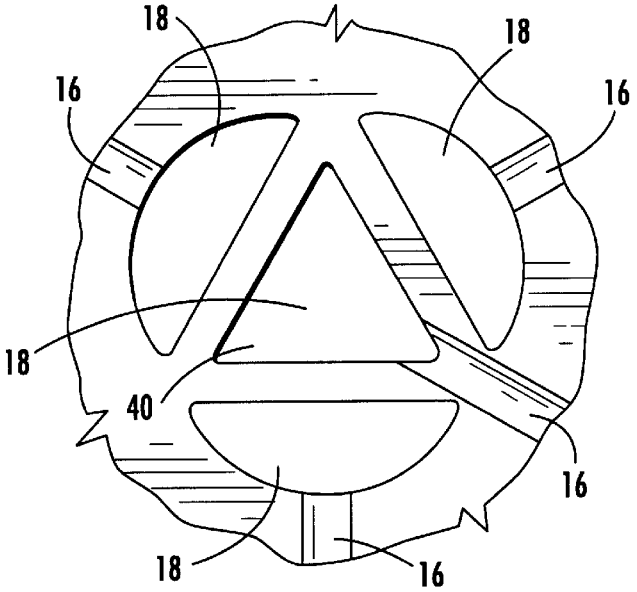
FIG. 3 is a top view of a distribution plate which can be used in the present invention, which could be used to produce a fiber like that shown in FIG. 2.

In an embodiment of the invention which is particularly well-suited for the production of multi-component fibers, the distribution plate 14, illustrated in FIG. 3, has at least two flow paths 16 which are designed to feed to a single spinneret backhole 30 (i.e., flowable material exiting from several of the exit holes 18 is designed to ultimately feed to a single spinneret backhole). In this embodiment, the pressure increase through any one of the orifices 24 of the metering plate 22 is sufficiently large in comparison to the difference in pressure drop between the flow paths 16, to thereby produce a plurality of flowable material streams in which the pressure of each material stream is substantially equilibrated to the pressure of any other material stream of the plurality. The pressure increase through the metering orifices is also desirably greater than the pressure required to fill the shaped distribution plate exit hole, so this shaped area is filled before material flows steadily through the metering orifices. This insures that flowable material flows consistently through all the metering orifices downstream of each of the shaped exit holes.

Figure 2:
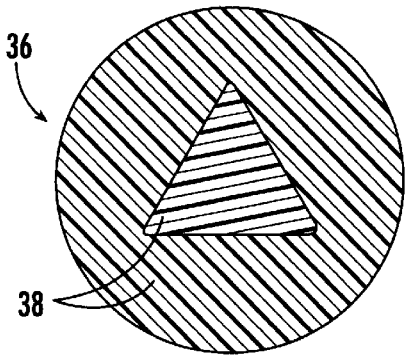
FIG. 2 is a cross-sectional view of a composite fiber which is exemplary of those which might be made according to the present invention.

It is understood that the apparatus of the current invention can be used to form a variety of different synthetic fibers. For illustration purposes, FIG. 2 shows the cross-sectional dimension of a synthetic fiber 36 which is exemplary of one which might be formed by the synthetic fiber forming apparatus 10. In the production of this fiber 36, the synthetic fiber forming apparatus 10 has a distribution plate 14 which has shaped exit holes 18 which approximate the cross-sectional shape of the fiber to be produced. The shapes of the exit holes 18 are designed such that their combined shape roughly approximates the cross-sectional shape 38, shown in FIG. 2, of the desired synthetic fiber 36. In the embodiment illustrated, the cross-sectional shape of the fiber includes a substantially triangular core and a round sheath surrounding the core. However, as will be clear to those skilled in the art, the invention will have applicability to fibers of many different shapes other than the one specifically described for purposes of illustration of the invention.

In this configuration, the flow paths 16 distribute flowable material to the distribution plate shaped exit holes 18 where, due in part to the metering action of the downstream metering plate 22, the flowable material roughly fills the cross-sectional dimension of each of the distribution plate exit holes 18. The distribution plate exit holes 18 produce and distribute shaped, flowable material streams to the plurality of orifices 24 of the metering plate 22, which is desirably positioned beneath the distribution plate 14.

Figure 5:
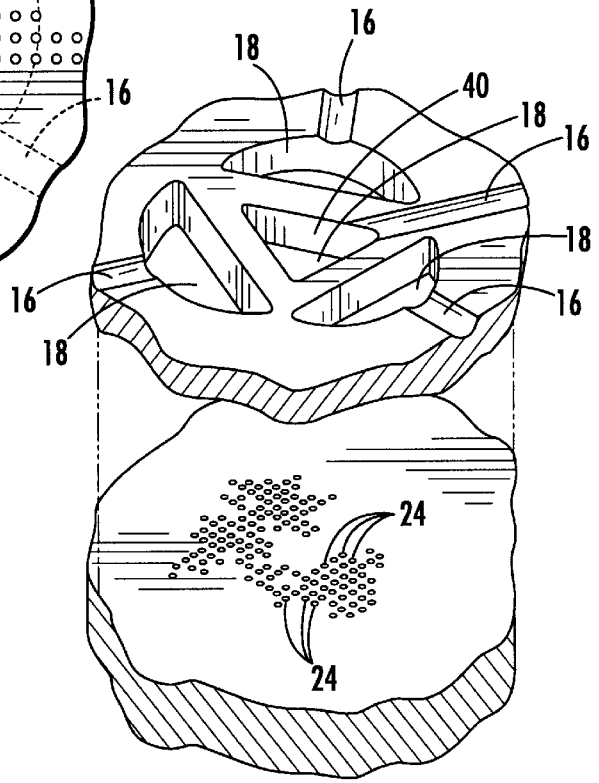
FIG. 5 is a perspective exploded view which illustrates the distribution plate of FIG. 3 as it appears when it is positioned upstream of and in fluid flow connection with the metering plate of FIG. 4.

In the embodiment of the invention illustrated in FIGS. 3–5, the plurality of orifices 24 of the metering plate 22 receive the shaped material stream and output a plurality of material streams which collectively substantially maintain the predetermined shape 38. Because the material may have traveled through flow paths of various different lengths on the distribution plate, the material streams which exit the distribution plate 14 may be at varying pressures. Because all of the streams are then caused to travel through the metering plate 22, each of the streams which emerges from the metering plate tends to emerge at a pressure which approximates that of each of the other material streams. The streams emerge from the metering plate 22 in a configuration approximating that desired for the spun fiber, and are fed into the backhole of the spinneret.

In operation, the process involves the step of directing a flow of material across a distribution plate 14, and thereafter through at least one exit hole 18 to an adjacent metering plate 22 having at least two downstream orifices 24 which act to meter the flow of the material therethrough. In embodiments where the metering plate is used simply to balance the pressures between individual streams rather than maintain a specific shape imparted by a shaped exit hole, it will be appreciated that a single metering hole could be used to correspond with each of two or more exit holes to meter the flow of a material flowing therethrough and substantially equilibrate the flow of each of the respective flowable material streams. Preferably, the metering plate is positioned immediately downstream of the distribution plate, though it is to be noted that one or more plates could be positioned intermediate the distribution plate 14 and the metering plate 22. In other words, the word "thereafter" is used to define that the metering plate is located in the spinning arrangement at a position downstream of one or more distribution plates in order to increase the equilibration and/or improve the pressure of one or more flowable material streams subsequent to travel through a distribution plate and prior to entering the backhole of the spinneret. As noted above in the discussion of the apparatus, the orifice in the metering plate is desirably relatively smaller than the exit hole 18 in the distribution plate, as the arrangement has been found to effectively moderate and control the pressure of the flowable material. Thereafter the moderated pressure flowable material from the downstream end of the orifice 24 is directed to a spinneret 32. In alternate embodiments, the directing step comprises either directing a flowable material or a shaped, flowable material stream into a plurality of orifices 24 in a metering plate 22, and thereafter to a spinneret 32.

Thus, the process of the present invention can serve to equilibrate the pressure of the flow of the plurality of flowable materials and therefore to increase the ease of achieving uniformity of fibers, including those of complex cross-sections. In certain embodiments of the present invention, the pressure created by the metering plate 22 can be sufficient to operate the spinning process, thereby obviating the need for a conventional metering plate upstream of the distribution plate 14. Alternatively, a second metering plate 34 can be provided upstream of the distribution plate 14, to feed the material to the distribution plate 14 at an initially equilibrated pressure, with the downstream metering plate 22 securing, among other things, to reduce pressure irregularities imparted between the upstream metering plate 34 and the downstream metering plate.

Figure 6:
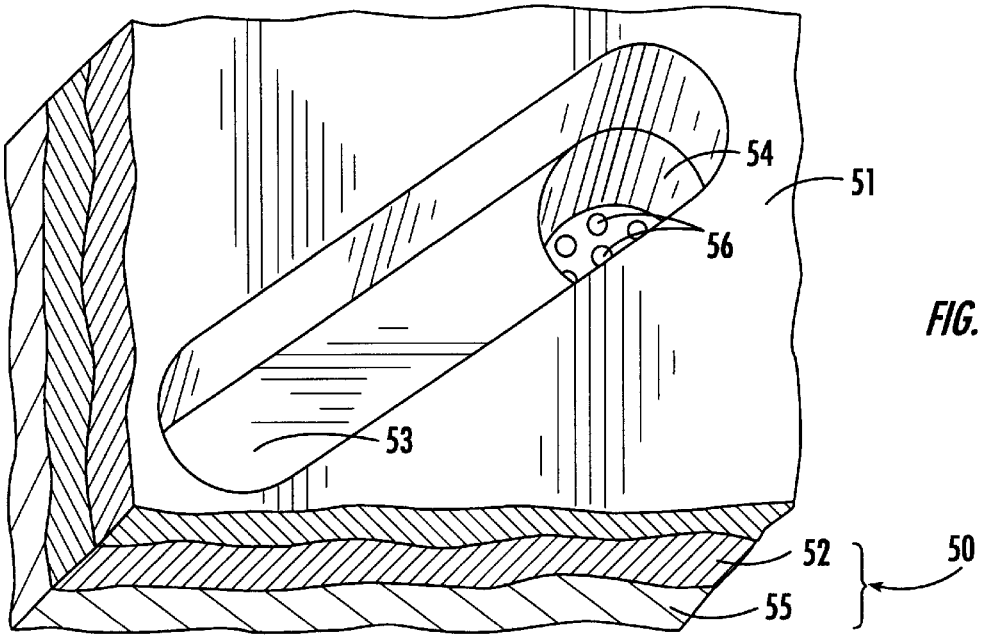
FIG. 6 is a perspective top view of an alternative distribution/metering plate embodiment.

FIG. 6 illustrates an alterative distribution/metering plate arrangement useful in performing the instant invention. In this embodiment, a distribution plate, shown generally at 50, directs a flowable material from an upstream supply source (not shown) to a downstream metering plate 55 having a plurality of exit orifices 56. The distribution plate 50 is provided as two separate plate sections: in the illustrated embodiments the first plate section 51 includes a channel 53 which extends through its full thickness to define a flow path in the distribution plate, while a second plate section 52 includes an opening 54, which forms the exit hole of the distribution plate. The respective distribution plate sections 51, 52 collectively define a flow path and exit hole arrangement similar to that provided by the single distribution plate 14 illustrated in FIGS. 1, 3 and 5. The plate sections are preferably designed to fit closely together such that material flowing though the channel 53 and opening 54 does not have a tendency to seep between the plate sections. Furthermore, the plate sections 51, 52 can be specially configured to facilitate their tight securement together (e.g., by forming one of the plate sections with a protrusion and the other with a mating depression, such that the plate sections are properly aligned relative to each other, the protrusion and depression are mated together). A metering plate 54 is positioned immediately downstream of the distribution plate 50, and includes a plurality of orifices 56 in fluid flow connection with the orifice 54 in the second distribution plate section 52. These orifices 56 are adapted to regulate the flow of material therethrough and into the spinneret; in the illustrated embodiment, the orifices 56 are substantially smaller than the orifice 54 in the second distribution plate section, so that they act to meter the flow of material through the metering plate, as well as material through the distribution plate sections 51 and 52. While only a single distribution plate 50 and metering plate 55 are shown, it is noted that plural distribution and metering plates can be provided to achieve the fiber configuration desired.

Figure 7:
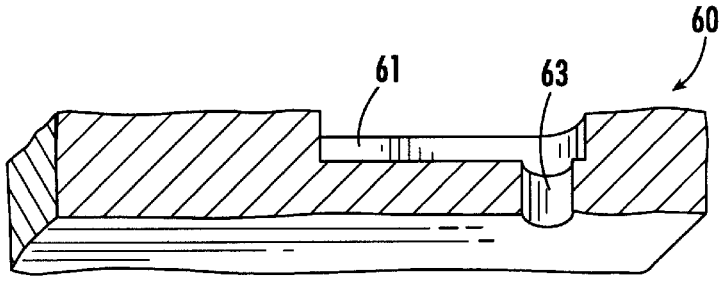
FIG. 7 is a cross-sectional view of an alternative embodiment of the distribution plate shown in FIG. 6, with the distribution plate being in the form of a single plate rather than plural plate sections.

It is to be noted that while for purposes of illustration the individual distribution plates have been depicted as separate elements, they can be integrally formed as a single unit within the scope of the instant invention. For example, FIG. 7 illustrates a distribution plate 60 designed to provide substantially the same flow path pattern as that shown in FIG. 6, through the use of a single plate having overlying flow path 61 and exit hole 63 portions of different configurations. In this way, the single distribution plate can provide substantially the same flow pattern as the dual plate system shown in FIG. 5.

Figure 8:
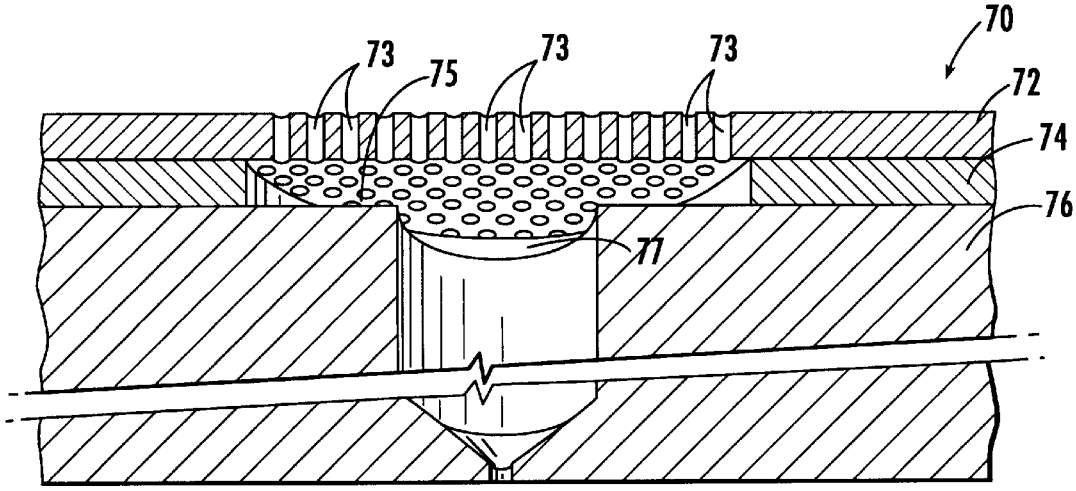
FIG. 8 is a cross-sectional view of an alternative arrangement for the junction of a metering plate with a spinneret which can be used in the instant invention.
Figures 9, 10, 11:
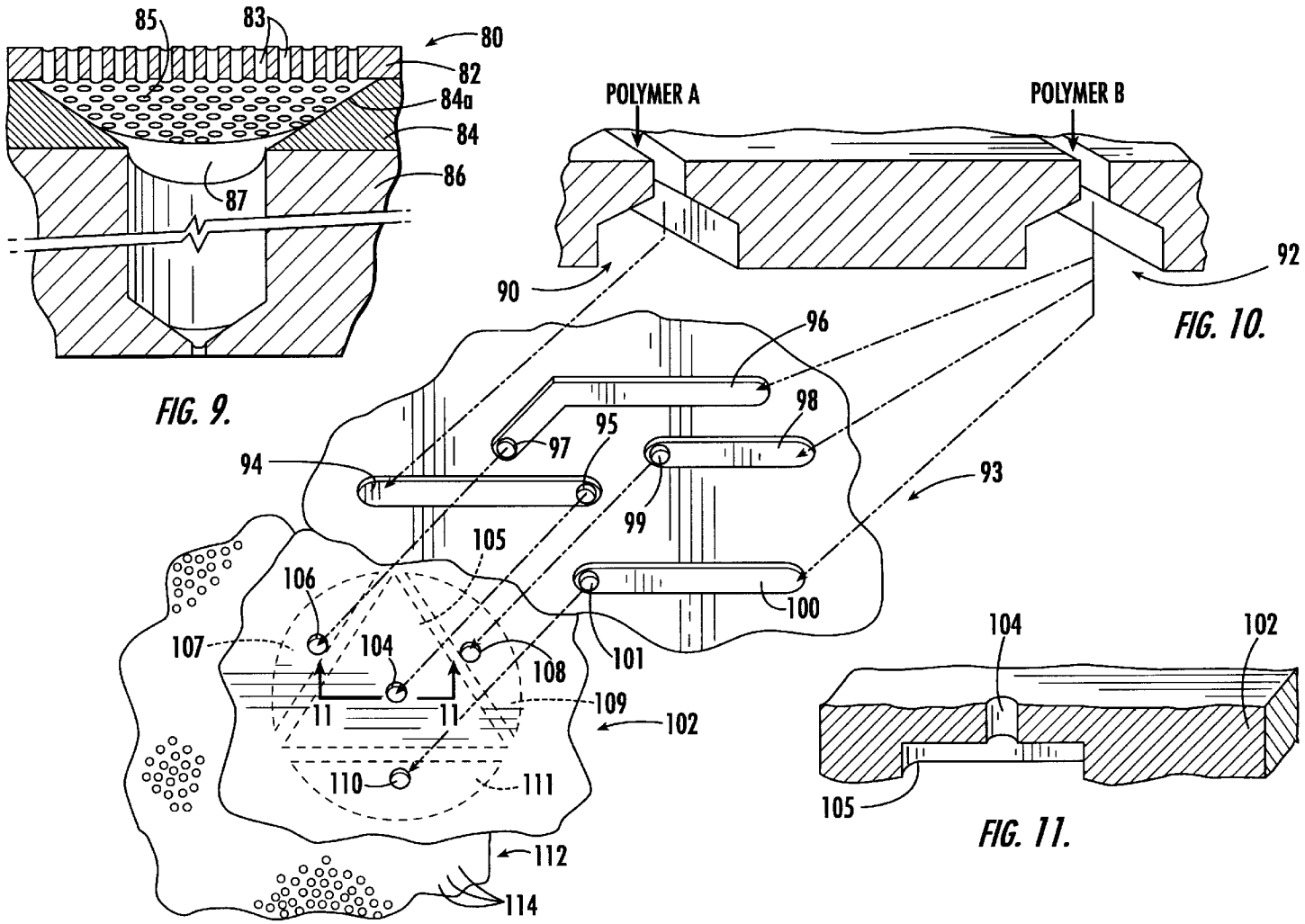
FIG. 9 is a cross-sectional view of a further alternative arrangement for the junction of a metering plate with a spinneret which can be used in the instant invention.
FIG. 10 is an exploded partial cross-sectional, partial top view of a distribution plate/metering plate arrangement which can be used in the instant invention.
FIG. 11 is a cross-sectional view of a distribution plate, as taken along line 11—11 in FIG. 10.

In the spinning assembly illustrated in FIG. 1, the metering plate 22 is positioned immediately upstream of the spinneret backholes, so that it feeds the flowable material stream directly into one or more of the spinneret backholes. However, a further alternative arrangement of the metering plate relative to the spinneret backholes useful in performing the instant invention is shown in FIG. 8. In this arrangement, shown generally at 70, a transition plate 74 is positioned intermediate the metering plate 72 and the spinneret 76. The transition plate 74 desirably includes an orifice 75 which is relatively larger than the backhole 77 of the spinneret, so as to effectively expand the diameter of the backhole. In this way, a greater number of exit holes 73 of the metering plate 72 can be directed to a single backhole 77, thereby enabling the production of fibers having even greater degrees of complexity. Although the orifice 75 of the transition plate is illustrated as having substantially straight walls 75*a* which extend substantially parallel to the walls of the spinneret backhole, it is to be noted that the orifice can also be substantially conical or otherwise shaped, so as to have a relatively wider diameter upstream (adjacent to the metering plate) and a relatively narrower diameter downstream (adjacent to the backhole of the spinneret). For example, FIG. 9 illustrates an alternative spinning arrangement, shown generally at 80, having a transition plate 84 positioned intermediate a metering plate 82 and a spinneret 86. Like the arrangement shown in FIG. 8, the transition plate 84 includes an orifice 85 which is relatively larger than the backhole 87 of the spinneret 86, so as to effectively expand the diameter of the backhole and enable a greater area of the metering plate 82 (and thus a correspondingly greater number of orifices 83) to feed a single spinneret backhole. In this arrangement, the orifice on the transition plate has tapered walls 84*a* rather than straight ones like those illustrated at 74*a* in FIG. 8. In addition, the transition plate 84 in this arrangement has a relatively large thickness T (for example, as shown compared with the thickness t of the metering plate) which enables a gradual combining of the plural material streams exiting the metering plate 82 and entering the backhole 87 of the spinneret 86.

FIGS. 10 and 11 illustrate another distribution plate/metering plate arrangement according to the instant invention. In this arrangement, a first flowable material (indicated as Polymer A) is provided in a conventional manner through supply channel 90, while a second flowable material (indicated as Polymer B) is provided in a conventional manner through supply channel 92. Preferably, the first flowable material differs from the second flowable material such that a multi-component fiber is produced therefrom.

The flowable materials are supplied to a first distribution plate 93 as follows: Polymer A is fed from supply channel 90 to flow path 94, where it is directed through a downstream exit hole 95, while Polymer B is fed from supply channel 92 to flow paths 96, 98, 100, where it is directed through their respective exit holes 97, 99, 101 in the form of strategically located flowable material streams. The exit holes 95, 97, 99, 101 are respectively in fluid flow connection with flow paths 105, 107, 109, and 111 (by way of entry holes 104, 106, 108 and 110) in distribution plate 102, which is positioned adjacent to the first distribution plate 93. As can be seen more readily in FIG. 11, the second distribution plate 102 is formed such that the flow paths 105, 107, 109, and 111 are formed on the downstream surface of the plate, and terminate in exit holes which are substantially the same dimensions as the flow paths. In other words, this second distribution plate appears substantially as an upside-down version of a distribution plate like that of first distribution plate 93 (although in this illustration the exit holes 105, 107, 109, and 111 of the second distribution plate 102 are differently shaped from the flow paths 94, 96, 98 and 100 of the first distribution plate), and the exit holes have substantially the same dimensions as the flow paths.

Because of the presence of downstream metering plate 112, the flowable material flowing through the paths 104, 106, 108, and 110 fills the relatively larger, shaped exit holes 105, 107, 109, and 111, thereby flowing to the downstream metering plate 112 in the form of shaped, strategically located flowable material streams. These polymer streams then flow through the orifices 114 in the metering plate 112, such that they exit the metering plate in the form of fine streams of flowable material (i.e., Polymers A and B) which are arranged so as to substantially assume the configuration collectively formed by the exit holes 105, 107, 109, and 111 in the second distribution plate 102. These streams are then directed into one or more backholes of a spinneret at pressures which are substantially equilibrated, despite the difference in the lengths of the different flow paths along distribution plate 93, as a result of the metering action of metering plate 112. Again, while only a single metering plate and two distribution plates have been shown, a greater number of each of these elements can be provided as desired to achieve a specific fiber construction. Furthermore, other intermediate plates (e.g., transition plates) can be provided as desired within the scope of the instant invention.

Figure 12:
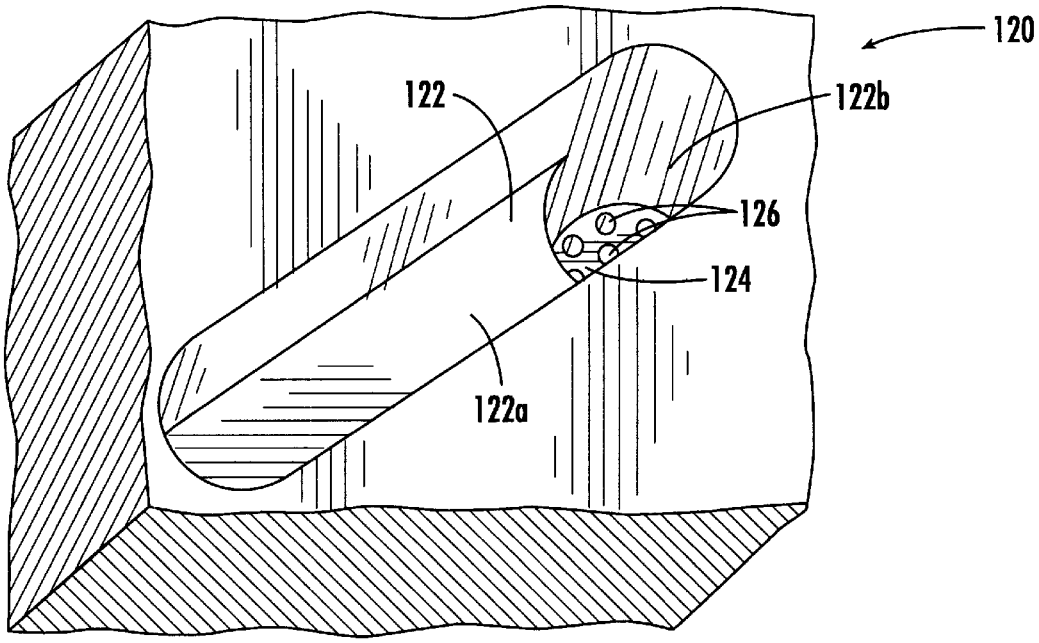
FIG. 12 illustrates an embodiment of the invention similar to that shown in FIG. 6, with the distribution plate and metering plate being integrally formed as a single unit.

FIG. 12 illustrates an alternative embodiment of the invention, in which the distribution plate 122 and downstream metering plate 124 are integrally formed as a single unit 120. Like the embodiments discussed above, the distribution plate 122 includes a flow path 122*a* and an exit hole 122*b* through which a flowable material can be output to a metering plate 124. The metering plate 124 portion of the unit 120 includes a plurality of orifices 126 which are in fluid flow connection with the distribution plate 122 portion of the unit, and are adapted to moderate the pressure of a flowable material flowing therethrough.

Figure 13:
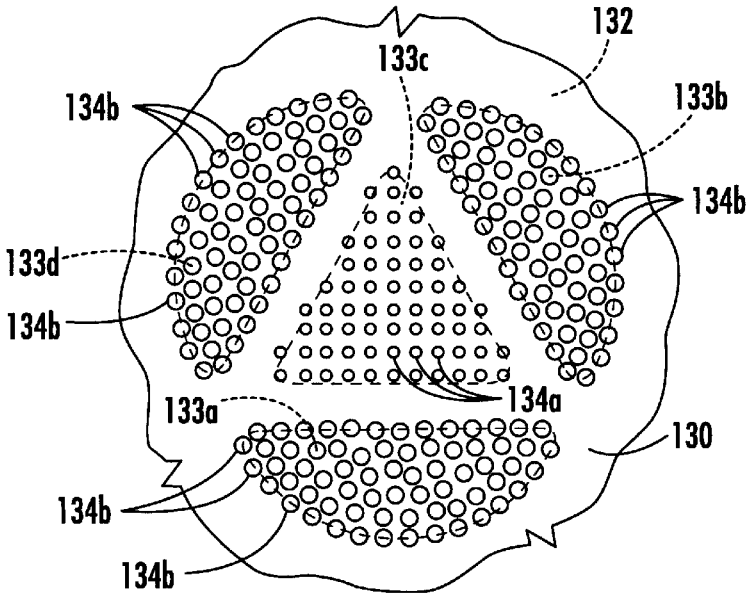
FIG. 13 is an illustration of an alternative metering plate construction which has differently-sized orifices in selected areas of the plate.

FIG. 13 illustrates an alternative metering plate 130 which can be used in the instant invention. The metering plate is shown as it would appear when it is positioned beneath a distribution plate 132 similar to that shown in FIGS. 4 and 5. In this metering plate 130, however, the orifices 134*a*, 134*b* of the plate adapted to correspond to different flow paths 133*a*, 133*b*, 133*c*, and 133*d* in the distribution plate 132 are differently configured to thereby differently moderate the pressure of flowable material flowing through the respective corresponding flow paths in the distribution plate. In the illustrated embodiment, the orifices are differently sized, although it is noted that they could be differently shaped or otherwise differently configured to achieve the desired pressure moderation, within the scope of the instant invention.

In the drawings and the specification, there have been set forth preferred embodiments of the invention, and although specific terms are employed, they are used in a generic and descriptive sense only and not for the purposes of limitation, the scope of the invention being defined in the claims.

That which is claimed is:

1. An apparatus for forming synthetic fibers in a spinning direction comprising:

a first distribution plate oriented substantially perpendicular to the spinning direction, said first distribution plate defining at least one flowpath generally perpendicular to said spinning direction and further defining at least one exit hole to output a flowable material in a direction generally parallel to the spinning direction;

a metering plate positioned downstream of the distribution plate, said metering plate being oriented in a direction generally perpendicular to the spinning direction and including at least two orifices, each extending generally parallel to said spinning direction downstream of the first distribution plate and forming a common flow path with the first distribution plate exit hole, each of said metering plate orifices moderating the pressure of material flowing from said first distribution plate through said metering plate, said metering plate orifices further providing a flow of material to a single backhole of a spinneret.

2. An apparatus according to claim 1, wherein said distribution plate exit hole forms part of the downstream surface of said first distribution plate, and wherein said metering plate orifices have peripheral dimensions which are smaller than a peripheral dimension of said first distribution plate exit hole.

3. An apparatus according to claim 1, wherein said first distribution plate defines at least two separate flowpaths generally perpendicular to the spinning direction, each of said flowpaths having at least one exit hole for outputting flowable material in the form of a stream, and wherein said metering plate has at least one orifice corresponding to each of said exit holes in said distribution plate such that material flowing from a first of at least two flow paths exits the metering plate at a pressure which is substantially equal to that of the material from a second of the flow paths as it exits the metering plate.

4. An apparatus according to claim 3, wherein said metering plate has a plurality of orifices corresponding to each of said exit holes in said distribution plate.

5. An apparatus according to claim 3, wherein flowable materials output from each of said at least two flow paths are ultimately fed by the metering plate to either of a single backhole of a spinneret or an orifice transition plate which in turn feeds a single backhole of a spinneret.

6. An apparatus according to claim 2, wherein the peripheral dimensions of the metering plate orifices are sufficiently smaller than the size of the distribution plate exit hole to produce a defined pressure increase in the flowable material.

7. An apparatus according to claim 6, wherein the dimensions of the metering plate exit hole and the thickness of the metering plate are sufficiently dimensioned to create a pressure sufficient for the operation of the apparatus.

8. An apparatus according to claim 2, wherein said exit hole in said first distribution plate has a predetermined shape and said metering plate has a plurality of relatively smaller orifices which define common flow paths with said exit hole such that material flowing through said apparatus exits said metering plate as a plurality of material streams which collectively substantially define the shape of said distribution plate exit hole.

9. An apparatus according to claim 1, wherein each of said at least two orifices in said metering plate defines walls extending substantially parallel to the spinning direction, said walls providing drag to the flowable material, thereby metering its flow therethrough.

10. An apparatus according to claim 1, further comprising a transition plate positioned between a downstream end of said orifice in said metering plate and the backhole of a spinneret, said transition plate being adapted to enlarge the effective diameter of the spinneret backhole.

11. An apparatus according to claim 1, wherein the thickness of the metering plate is sufficiently sized to produce a defined pressure increase in the flowable material.

12. An apparatus according to claim 1, wherein said apparatus further comprises a second metering plate upstream of said first distribution plate for moderating the pressure of a flowable material supplied to said distribution plate.

13. An apparatus according to claim 1, wherein said generally perpendicular flowpath extends along the downstream surface of said first distribution plate.

14. An apparatus according to claim 1, wherein said generally perpendicular flowpath extends along the upstream surface of said distribution plate.

15. An apparatus according to claim 1, wherein said first distribution plate and said metering plate are integrally formed as a single unit.

16. An apparatus according to claim 1, wherein said first distribution plate comprises a first plate section having a channel which extends through substantially its full thickness to define a flowpath and a second plate section which includes an opening which defines the exit hole in said distribution plate.

17. An apparatus according to claim 1, further comprising a second distribution plate positioned between said first distribution plate and said metering plate, said second distribution plate having at least one generally perpendicular flowpath relative to the spinning direction in fluid flow connection with said first distribution plate and said metering plate.

18. An apparatus according to claim 17, wherein said flowpath in said second distribution plate extends along the downstream surface of said distribution plate.

19. An apparatus for forming synthetic fibers comprising:

a distribution plate for outputting a flowable material in a spinning direction;

a metering plate downstream of the distribution plate;

a flow path in said distribution plate for directing a flowable material in a direction substantially perpendicular to a spinning direction;

an exit hole forming part of a downstream surface of said distribution plate for directing a flowable material in the form of a shaped flowable stream; and a plurality of orifices in said metering plate, at least two of said plurality of orifices collectively forming common flow paths with the distribution plate exit hole, said plurality of metering plate orifices each being effectively smaller than said distribution plate exit hole for moderating the pressure of a material flowing from said distribution plate exit hole to said plurality of metering plate exit holes to thereby provide to a spinneret a plurality of flowable material streams which collectively substantially maintain the shape of the shaped flowable stream exiting the distribution plate at an enhanced pressure consistency.

20. An apparatus according to claim 19, wherein the size of the orifices of said metering plate and the thickness of the metering plate are formed such that the pressure of any flowable material stream is advantageously equilibrated to the pressure of any other flowable material stream of said plurality of flowable material streams.

21. An apparatus according to claim 20, wherein said distribution plate has at least two flow paths each in fluid flow connection with at least one of at least two distribution plate exit holes, wherein the pressure increase through any orifice of the plurality of orifices in the metering plate is larger than the difference in pressure drop between the flow paths, for producing a plurality of flowable material streams where the pressure of one stream of said plurality of flowable material streams is relatively equilibrated to the pressure of any other stream of said plurality.

22. An apparatus according to claim 21, wherein the orifices of the metering plate corresponding to one of the at least two flowpaths in the distribution plate are differently configured from those corresponding to another of the at least two flowpaths.

23. An apparatus according to claim 19, wherein the distribution plate exit hole is of a shape for producing and distributing a flowable material stream with a predetermined cross-sectional shape.

24. An apparatus in accordance with claim 23, wherein said plurality of orifices of the metering plate receive a shaped flowable material stream and output to the spinneret a plurality of flowable material streams, which collectively substantially maintain the predetermined shape.

25. An apparatus in accordance with claim 23, wherein said plurality of orifices of the metering plate receive a shaped flowable material stream and output to the spinneret a plurality of flowable material streams in which the pressure of one flowable material stream is approximately equilibrated to the pressure of any other flowable material stream.

26. An apparatus according to claim 19, wherein said plurality of orifices of said metering plate divide a flowable material stream to produce a plurality of flowable material streams oriented in the spinning direction for output to one of either the backhole of a spinneret or a transition plate which in turns feeds a spinneret backhole.

27. An apparatus according to claim 19, wherein said apparatus further comprises a metering plate upstream of said distribution plate for initially moderating the pressure of a material flowing to said distribution plate.

28. A process for improving the uniformity of synthetic fibers produced in a spinneret, the method comprising:

directing a flow of material in a direction perpendicular to that of the spinning direction by way of a distribution plate and through an exit hole thereof and thereafter through an adjacent metering plate having a plurality of orifices, each extending generally parallel to said spinning direction and forming a common flow path with the distribution plate exit hole and which are dimensioned relative to the exit hole of the distribution plate so as to thereby moderate and more consistently control the pressure drop of the flowable material; and thereafter directing the moderated pressure flowable material from each orifice of the metering plate to a corresponding backhole of a spinneret.

29. A process according to claim 28, wherein said step of directing a flow of material from a distribution plate to a metering plate comprises directing a flow of material to a metering plate having a plurality of orifices which are smaller than the exit hole in the distribution plate and producing a plurality of flowable material streams, to thereby moderate and more consistently control the pressure of the flowable material.

30. A process according to claim 29, wherein said step of directing a flow of material through a metering plate comprises adjusting the pressure of a plurality of flowable material streams to a desired pressure.

31. A process according to claim 30, wherein said step of directing a flow of material through a metering plate includes the step of approximately equilibrating the pressure between flowable material streams of the plurality.

32. A process according to claim 28, wherein said step of directing a flow of material through a metering plate comprises dispensing a predetermined shaped, flowable material stream to said plurality of orifices in said metering plate.

33. A process according to claim 32, wherein said step of directing a flow of material through a metering plate comprises flowing a shaped, flowable material stream through said plurality of orifices creating a plurality of flowable material streams which collectively substantially maintain the predetermined shape.

34. A process according to claim 32, wherein said step of directing a flow of material through a metering plate comprises flowing a flowable material through said plurality of orifices to create a plurality of flowable material streams, wherein the pressure of one flowable material stream is approximately equilibrated to the pressure of any other flowable material stream.

35. A process according to claim 28, wherein said step of directing a flow of material through a metering plate comprises the step of creating a pressure on a flowable material sufficient to operate said process.

36. An apparatus according to claim 1, wherein said metering plate orifices are dimensioned such that the pressure of material exiting each of said metering plate orifices is substantially equal.

37. A process according to claim 28, wherein said metering plate orifices are dimensioned such that the pressure of materials exiting each of said metering plate orifices is substantially equal.

38. A process for improving the uniformity of synthetic fibers produced in a spinneret, the method comprising:

directing a flow of material in a direction perpendicular to that of the spinning direction by way of a distribution plate defining at least two separate flowpaths generally perpendicular to the spinning direction, each of said flowpaths having at least one exit hole for outputting flowable material in the form of a stream, said flowpaths inducing different pressure drops in said flowable material passing through said flowpaths;

directing a flow of material through said exit hole of the distribution plate and thereafter through an adjacent metering plate having a plurality of orifices which are dimensioned relative to the exit hole of the distribution plate so as to thereby moderate and more consistently control the pressure drop of the flowable material; and thereafter directing the moderated pressure flowable material from each orifice of the metering plate to a corresponding backhole of a spinneret.

* * * * *

UNITED STATES PATENT AND TRADEMARK OFFICE

CERTIFICATE OF CORRECTION

PATENT NO. : 6,361,736 B1
DATED : March 26, 2002
INVENTOR(S) : Dugan et al.

It is certified that error appears in the above-identified patent and that said Letters Patent is hereby corrected as shown below:

Title page, Item [54] and Column 1, line 1,
In the Title after "APPARATUS" insert -- AND AN ASSOCIATED PROCESS --.

Signed and Sealed this

First Day of October, 2002

*Attest:*

*Attesting Officer*

JAMES E. ROGAN
*Director of the United States Patent and Trademark Office*